United States Patent [19]

Isobe et al.

[11] 4,069,907

[45] Jan. 24, 1978

[54] HIGH SPEED PRINTER HAVING SPOKES WITH A PLURALITY OF SECTIONS CONNECTED TOGETHER AT AN ANGLE GREATER THAN ZERO

[75] Inventors: Minoru Isobe, Tokyo; Akiumi Kuriyama, Kodaira, both of Japan

[73] Assignee: Oki Electric Industry Co., Ltd., Tokyo, Japan

[21] Appl. No.: 742,999

[22] Filed: Nov. 18, 1976

[30] Foreign Application Priority Data

Nov. 21, 1975 Japan ..... 50-139247

[51] Int. Cl.[2] ..... B41J 1/30

[52] U.S. Cl. ..... 197/53; 197/18

[58] Field of Search ..... 101/93.14, 110, 111; 197/6.7, 18, 36, 53, 54

[56] References Cited

U.S. PATENT DOCUMENTS

| | | | |
|---|---|---|---|
| 2,236,663 | 4/1941 | Adams | 197/53 |
| 3,651,916 | 3/1972 | Becchi | 197/54 |
| 3,677,386 | 7/1972 | Kierterich et al. | 197/53 |
| 3,760,925 | 9/1973 | Bossi | 197/53 |
| 3,901,370 | 8/1975 | Poulton | 197/6.7 |
| 3,915,086 | 10/1975 | McManaman | 197/53 X |

*Primary Examiner*—Paul T. Sewell

*Attorney, Agent, or Firm*—Armstrong, Nikaido & Marmelstein

[57] ABSTRACT

A high speed printer utilizing a rotating type wheel having a plurality of spokes with at least two type characters, an outer type character and an inner type character.The spokes extend from the center of the wheel and each type character is preferably supported on the face of a corresponding spoke or radial extension. During the rotation of the type wheel, the wheel is moved in a plane parallel to the path of line printing. An outer character is formed at a predetermined angle to an inner character at one extreme end of a spoke. With each predetermined angular rotation of the wheel, the desired character may be printed in a columnar print position on the printing line.

4 Claims, 4 Drawing Figures

HIGH SPEED PRINTER HAVING SPOKES WITH A PLURALITY OF SECTIONS CONNECTED TOGETHER AT AN ANGLE GREATER THAN ZERO

BACKGROUND OF THE INVENTION

The present invention relates to a high speed printer capable of printing information received from data handling apparatus, such as computers or calculators etc.

With the advent of computer technology and advances in the art of data processing, requirements for increased speed of handling information have become more stringent. One known type of rapid readout with permanent recordation incorporates a high speed printer that employs a character type ball bearing the characters to be printed on the outer surface of the ball. However, a type ball printer has the disadvantages that the printing speed is not sufficient and that a type ball is expensive.

The other prior high speed printer employs a type wheel having the characters to be printed at the outer periphery of respective spokes forming the wheel. The U.S. Pat. No. 3,356,199 is an example of a type wheel printer. However, said type wheel printer has the disadvantage that the number of type characters mounted on a single type wheel is limited. If we want to increase the number of type characters, the diameter of the type wheel or the length of the spokes must be increased, but the increase in the diameter of the wheel would increase the inertia of the wheel and reduce it's printing speed. Therefore the upper limit of the number of type characters available on said type wheel printer is only 60 or 70 characters.

In order to overcome the disadvantage of the prior type wheel printer, an improvement on the structure of the spokes of the wheel has already been proposed. In said improvement, a pair of type characters are mounted on a single spoke directly on the straight axis line of the spoke. However, said printer has the disadvantages that the type wheel must be shifted upward and/or downward during the high speed rotation of the wheel, in order to select the desired character from the pair of characters on each spoke, and the up/down shift operation of a wheel reduces substantially the operational speed of the printer. The operational speed of said printer is only 40 characters in each second.

SUMMARY OF THE INVENTION

It is an object, therefore, of the present invention to overcome the disadvantages and limitations of the prior printers by providing a new and improved high speed printer.

According to the present invention, a high speed printer comprises a rotary wheel having a plurality of groups of type characters on the surface of one side, the groups of characters being arranged in concentric circles on the rotary wheel, and the axis of one group of characters is offset at a predetermined angle from the axis of another group of characters, means for rotating said wheel during each cycle of line printing in a plane parallel to the printing line, a plurality of print hammers provided for each character group spaced by an integer multiple of a unit space of a printed character for striking selected characters causing said characters to be printed on a recording medium, and means for transporting said wheel and hammers relative to a record medium along a predetermined line of printing.

BRIEF DESCRIPTION OF THE DRAWINGS

The foregoing and other objects, features and attendant advantages of the present invention will be appreciated as the same become better understood by means of the following description and the accompanying drawings wherein.

DESCRIPTION OF THE PREFERRED EMBODIMENT

Figure 1:
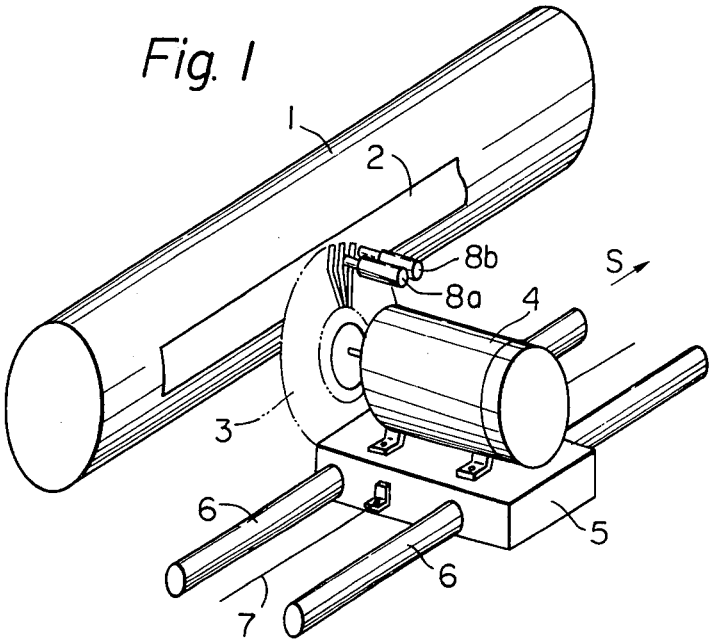
FIG. 1 is a perspective view showing the structure of the present high speed printer, FIG. 2 (A) and FIG. 2 (B) are a part of the plane view of the type wheel according to the present invention.

FIG. 1 shows the structure of one embodiment of the high speed printer according to the present invention. In FIG. 1, the reference numeral 1 is a platen, 2 is an ink ribbon, 3 is a type wheel, 4 is a servo motor for rotating the type wheel, 5 is a carriage carring said servo motor 4 and said carriage 5 can be moved in a horizontal direction, 6 is a guide post for guiding the movement of said carriage 5, 7 is a spacing wire for moving or driving said carriage 5, and **8*a* and 8*b* are hammers. The distance between the hammers 8*a* and 8*b*** is an integer multiple of the unit space length of a character and is preferably a common multiple of 1/12 inch or 1/10 inch since two standards concerning the unit width of a character are utilized in the world, in one standard 10 characters are printed in an inch and in the other standard 12 characters are printed in an inch.

Figure 2A:
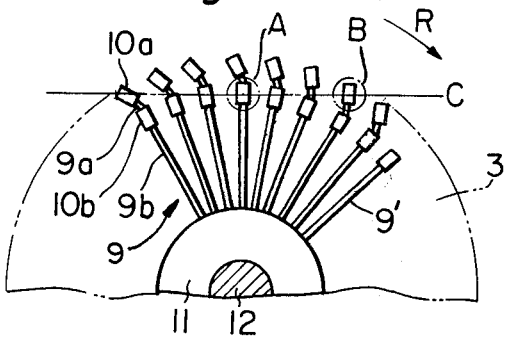
Figure 2B:
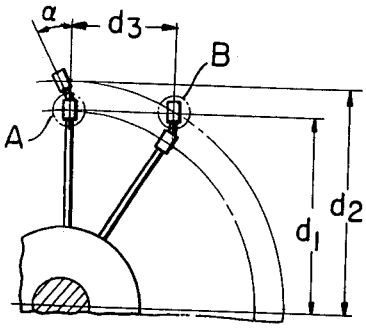

FIG. 2 (A) and FIG. 2 (B) show the type wheel 3 in detail.

The type wheel 3 comprises a plurality of flexible spokes 9 radiating in all directions on one plane, a pair of type characters **10*a* and 10*b* supported at the extreme end of each spoke, a base portion 11 for supporting said spokes, and an axis 12 for connecting the wheel 3 to the servo motor 4. The type character 10*a* can be omitted as shown in the spoke 9' when the same is unnecessary. The wheel is made of, preferably, a plastic such as nylon. The spoke 9 has a pair of sections 9*a* and 9*b* connected together at a predetermined angle, and each section 9*a* and 9*b* has the type characters 10*a* and 10*b* at the extreme end of each section respectively. The axis or the direction of the characters 10*a* and 10*b* coincides with the direction of the axis of the sections 9*a* and 9*b*, respectively. The type character 10*b* which is mounted on the first section 9*b* can be typed directly onto the recording medium when the spoke 9 is positioned at the point A, while the type character 10*a* which is mounted on the second section 9*a* can be typed directly onto the recording medium when the spoke rotates by a predetermined angle in the direction shown by the arrow R and is positioned at the point B. It should be noted that both the points A and B are on the horizontal line C. Accordingly the print hammer 8*a* strikes a type character on the section 9*b* at the point A, and the other print hammer 8*b* strikes a type character on the section 9*a* at the point B. Therefore, the changing of the character groups 10*a* and 10*b* from 10*a* to 10*b* and vice versa can be performed by the switching of the print hammers 8*a* and 8*b*. Since the print hammers are drived by electromagnets, said switching of the print hammers is performed electrically without the vertical movement of the type wheel 3. In order to print a character at the point B, in the space next to a character printed at the point A, the carriage 5 which carries the type wheel 3 and the print hammers 8***a* and 8*b* must be driven backward (reverse direction to the arrow S), for a predetermined distance defined by the distance between the points A and B. The distance between the points A and B is an integer multiple of the unit space length of the character. It should be appreciated that said backward movement of the carriage 5 for the switching of the print hammers does not require any additional mechanical members in the printer, since the carriage 5 is originally designed to move along the arrow S in either direction, driven by the spacing wire 7 for normal printing.

The preferred numerical embodiment according to the present invention is with reference to FIG. 2 (B); the length $d_1$ is 26.6mm, the length $d_2$ is 32mm, the length $d_3$ is 17.78mm, the angle $\alpha$ is 39° 22.5′, the number of spokes on the wheel is 64, and the printing speed is 80 characters per/second.

Figure 3:
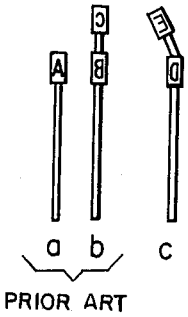
FIG. 3 shows some examples of the structure of a spoke of a type wheel.

Finally, the structures of some spokes are shown in FIG. 3 for the clarification of the feature of the invention. In FIG. 3 the structures *a* and *b* are prior art, and the structure C having the angle between two sections concerns the present invention.

From the foregoing it will now be apparent that a new and improved high speed printer has been found. It should be understood of course that the embodiment disclosed is merely illustrative and is not intended to limit the scope of the invention. Various modifications and alternatives of the embodiment described above are possible within the scope of the invention. For instance, the arrangement of the paper and ribbon relative to the type wheel and the hammers may be changed, and the drive system may be modified accordingly. Further a spoke having more than three sections having an angle between each successive section may be possible.

We claim:

1. A high speed printing apparatus comprising a rotary wheel having a plurality of spokes, each of said spokes having a plurality of type characters on the surface of one side, means for rotating said wheel during each cycle of line printing in a plane parallel to the printing line, at least two print hammers for striking selected characters causing said characters to be printed on a recording medium, and means for transporting said wheel and said hammers relative to a record medium along a predetermined line of printing, characterized in that, said spokes have a plurality of sections connected together at a predetermined angle greater than zero, each section having a type character on the surface of one side and wherein said at least two print hammers are horizontally aligned with the line printing.

2. A high speed printing apparatus according to claim 1, wherein said wheel is made of a plastic.

3. A high speed printing apparatus according to claim 1, wherein the distance between each of said hammers is an integer multiple of the unit space length of each character.

4. A high speed printing apparatus comprising a rotary wheel having a plurality of groups of type characters on the surface of one side, the groups of characters being arranged in concentric circles on the rotary wheel, the axis of each character of one group of characters being offset at a predetermined angle greater than zero from the axis of each character of another group of characters, means for rotating said wheel during each cycle of line printing in a plane parallel to the printing line, a plurality of horizontally aligned print hammers one print hammer being provided for each character group and spaced by an integer multiple of a unit space of a printed character for striking selected characters causing said characters to be printed on a recording medium, and means for transporting said wheel and hammers relative to a record medium along a predetermined line of printing.

* * * * *

UNITED STATES PATENT AND TRADEMARK OFFICE

CERTIFICATE OF CORRECTION

PATENT NO. : 4,069,907

DATED : January 24, 1978

INVENTOR(S) : MINORU ISOBE ET AL

It is certified that error appears in the above-identified patent and that said Letters Patent are hereby corrected as shown below:

Please change the name of the assignee listed on the issued patent from:

"Oki Electric Industry Co., Ltd., Tokyo, Japan"

to:

--Oki Electric Industry Co., Ltd., Tokyo, Japan and Nippon Telegraph and Telephone Public Corporation, Tokyo, Japan--

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*